US006940030B2

(12) United States Patent
Takeda et al.

(10) Patent No.: US 6,940,030 B2
(45) Date of Patent: Sep. 6, 2005

(54) HINGE KEY SWITCH

(75) Inventors: Toshisada Takeda, Simi Valley, CA (US); Richard Acosta, Newbury Park, CA (US); Charles Fauble, Canyon County, CA (US); Chatree Sitalasai, La Crescenta, CA (US)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 10/406,728

(22) Filed: Apr. 3, 2003

(65) Prior Publication Data

US 2004/0195082 A1 Oct. 7, 2004

(51) Int. Cl.[7] ..... H01H 13/70
(52) U.S. Cl. ..... 200/343; 200/344; 200/5 A
(58) Field of Search ..... 200/314–345, 200/512–517, 5 A, 5 R; 400/472, 492, 495, 496, 488–491.2

(56) References Cited

U.S. PATENT DOCUMENTS 4,430,531 A * 2/1984 Wright ..... 200/5 A
5,144,103 A * 9/1992 Suwa ..... 200/344
5,763,841 A * 6/1998 Hasunuma ..... 200/5 A
5,767,463 A 6/1998 Gandre
5,772,008 A 6/1998 Yu et al.
5,912,443 A * 6/1999 Hasunuma ..... 200/5 A
5,914,468 A * 6/1999 Nishimura et al. ..... 200/5 A
5,967,298 A * 10/1999 Watanabe et al. ..... 200/344
5,986,227 A 11/1999 Hon
6,002,092 A 12/1999 Pan
6,027,267 A * 2/2000 Yokobori ..... 400/479
6,060,676 A 5/2000 Pan
6,107,584 A 8/2000 Yoneyama
6,150,624 A 11/2000 Yao
6,166,337 A * 12/2000 Flegeo ..... 200/5 A
6,204,462 B1 3/2001 Huang
6,242,705 B1 6/2001 Huang

* cited by examiner

*Primary Examiner*—Marina Fishman
(74) *Attorney, Agent, or Firm*—John J. Skinner, Jr.; Joel E. Lutzker; Schulte Roth & Zabel

(57) ABSTRACT

An apparatus for a hinged key switch is presented which operates around a hinged pivot point located external to the four points of the key cap, and which comprises a rubber spring providing a vertical bias and an arm with an extension which acts as a stopper when it abuts a raised portion of the mounting plate. The rubber spring is integrally formed from a rubber sheet which is supported on one side by the mounting plate and on the other by the back plate. The stopper extends vertically downward from the key cap and acts to limit the movement of the key in the vertical direction. A horizontal extension from a lower portion of the key cap further extends downward and through a slot in the mounting plate and has a hook which abuts an underside of the mounting plate, such extension from the key cap acting as the pivot point around which the key rotates.

17 Claims, 8 Drawing Sheets

HINGE KEY SWITCH

BACKGROUND OF THE INVENTION

The present invention relates to an apparatus for a hinge key switch, and more particularly to a construction of a key switch having a rubber spring which provides vertical resistance against a key cap, movement of which operates around a hinge point, and a stopper which acts to limit that movement.

DESCRIPTION OF THE RELATED ART

Information is input into electronic devices, such as computers and other types of data terminals, by means of a keyboard. Accordingly, the construction of the key switches of the keyboard becomes important in that the key switches must be durable and be able to be manually depressed in a consistent and easy manner. Two alternative methods of construction of these key switches have heretofore been contemplated. These two types of switches are commonly known as the "plunger-type" key switch and the "scissors-type" key switch.

Referring first to FIG. 7, a plunger-type key switch is illustrated according to the prior art. The plunger-type key switch 120 is constructed having a plunger 115 into which an extension 116, integrally connected to an underside of a key cap 105, fits. The plunger 115 is moveably situated in a chamber created by a raised step and a half integrally formed from a keyboard mounting plate 101 and generally extending from a horizontal plain in a vertical direction towards key cap 105 and plunger 115. Based on the construction form of the so-called raised step and a half, it accordingly acts as both a stopper mechanism and a guide for the plunger 115. Thus, the plunger-type key switch operates in a manner in which the axis of movement is in a vertical direction. Vertical movement of the plunger 15 in the chamber is assisted by a vertical sliding mechanism 116, which mechanism is situated on an outer circumference of the plunger 115.

The keyboard mounting plate 101 itself is affixed to a back plate 102. Disposed between the back plate 102 and the keyboard mounting plate 101 is a signal membrane 103. Further disposed between the keyboard mounting plate 101 and the back plate 102, a resistance mechanism is provided to bias the plunger 115 in a vertically upward direction within the confines of the chamber. This resistance mechanism can sometimes be a rubber spring 107, as shown in the figure. The rubber spring 107 acts to bias the plunger 115 in the vertically upwards direction. Overtime, however, movement of the plunger 115 is often inhibited by dust, dirt or other debris which work their way into the narrow space between the vertical sliding mechanism 116 and the vertically extended portion of the keyboard mounting plate 101. Also, because there are many interacting and moving parts, the plunger-type key switch is subject to breakage.

Referring now to FIG. 8, a scissors-type key switch is illustrated according to the prior art. The scissors-type key switch is constructed having a key cap 205 above a scissor mechanism 217. The key cap 205 and scissor mechanism 217 are mounted on a keyboard mounting plate 201 which is disposed on a back plate 202. Disposed between the mounting plate 201 and back plate 202 is a signal membrane 203. The scissor mechanism 217 is constructed of two arms which are connected via and rotate about a central pivot point 208. An upper portion of each of the two arms are connected opposite one another to an underside of the key cap 205, while a lower portion of each of the two arms sit in a slot in the mounting plate 201. At least one of the lower portion of the two arms of the scissor mechanism 217 is slideably mounted in the slot of the mounting plate 201, while the other may be mounted by a connecting pin or the like.

Accordingly, when key cap 205 is manually depressed in a vertically downward direction the two arms of scissor mechanism 217 rotate about pivot point 208 such that the lower portions of the two arms slide horizontally in opposite directions in the slot formed in the mounting plate 201. A rubber spring 207, formed about the scissor mechanism 217, connected to the back plate 201 and to the underside of the key cap 205, provides resistance in the vertically upward direction. When the manual depression of the key cap in the vertically downward direction ends the key cap is biased by the rubber spring 207 in a vertically upwards direction. However, it is possible that dirt, dust and other debris will lodge in the slot of the mounting plate 201, in which the lower portions of each of the arms of the scissor mechanism 217 are connected, or between the arms themselves such as to prevent proper sliding and/or movement. Also, because there are many interacting and moving parts, the scissors-type key switch is subject to breakage.

Thus, as an be seen, there remains a need for a key switch which will provide the same sort of vertical movement of the key cap when manually depressed, but will not be subject to interference by dirt, dust or other debris becoming lodged in the moving parts and which will be less subject to wear, tear and breakage.

SUMMARY OF THE INVENTION

Accordingly, the present invention is directed to a hinged key switch having a construction in which a key cap rotates about a hinge point away from the vertical axis of a resistance biasing mechanism.

In a preferred embodiment, the key cap is constructed as a single unitary form. That is, the key cap has a slightly depressed top surface, for easy gripping by a fingertip, and a ledge and finger(s) integrally connected to and extending therefrom towards the hinge point. At the end of the fingers, away from the top surface of the key cap, the fingers angle down into slots cut into a keyboard mounting plate. At a point below the surface of the keyboard mounting plate, the fingers angle back towards the main body of the key cap so as create a snap hook for securing the key cap to the keyboard mounting plate. The key cap's surface can further also have edges which angle down.

Further in the preferred embodiment, the resistance biasing mechanism comprises a circular extension, integrally connected to and extending from an underside of the key cap, and a raised circular portion of a rubber spring, integrally connected to and extending from a rubber sheet. The circular extension of the key cap and the raised circular portion of the rubber spring are formed so as to fit onto and contact one another and mutually cooperate. The rubber sheet is disposed between the keyboard mounting plate and the back plate. The rubber spring itself fits into a hollow formed in the keyboard mounting plate and operates for biasing in a vertically upwards direction against manual depression.

The present invention, including its features and advantages, will become more apparent from the following detailed description with reference to the accompanying drawings.

DETAILED DESCRIPTION

FIGS. 1 through 6 illustrate an apparatus for construction of a hinged key switch, in which a rubber spring acts as a biasing mechanism to bias a key cap in a vertical direction and in which movement of the key cap is controlled by a horizontal pivot point outside of the axis of vertical movement.

Figure 1:
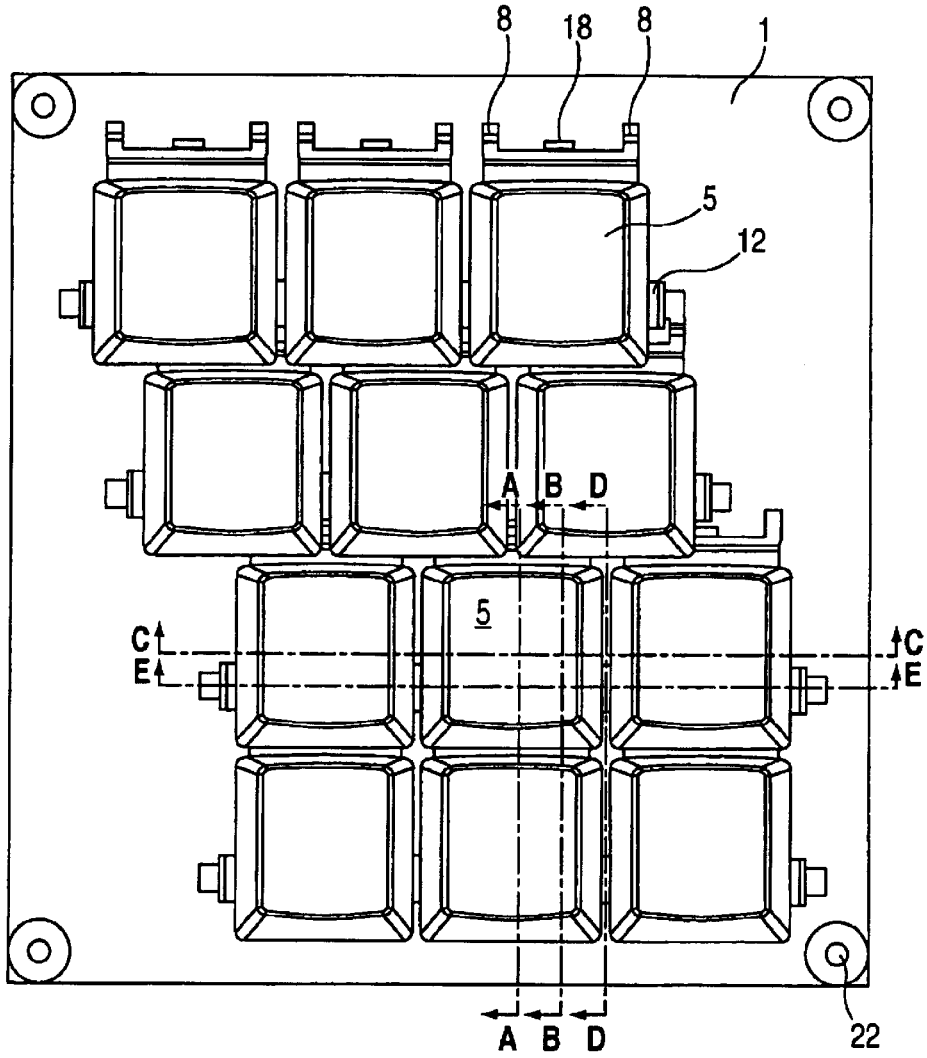
FIG. 1 is a top view of several hinge key switches fixed to a mounting plate, according to an embodiment of the present invention.

Referring now to FIG. 1, a keyboard mounting plate 1 is shown with a number of key caps 5 mounted thereon around pivot points 8. As can be seen from the figure, the rows of key caps can be mounted in either a structured column scheme or in a staggered column scheme. Mounting of the key caps in a structured scheme is shown in the figure by the bottom two rows, while the staggered scheme is shown by the top two rows. It is to be understood, of course, that the figure is merely illustrative and that other schemes of mounting of the key caps may be used. To assist in the process of mounting the key caps to the mounting plate, a raised stopper ridge 18 may be added on the surface of the keyboard mounting plate 1. the ridge 18 rises enough from the surface of the mounting plate 1 so that when key cap 5 is mounted thereon around pivot points 8, it comes into contact with stopper ridge 18. FIGS. 2 through 6 are representations of the hinged key switches along the respective axes A, B, C, D and E as drawn on the figure.

Figure 2:
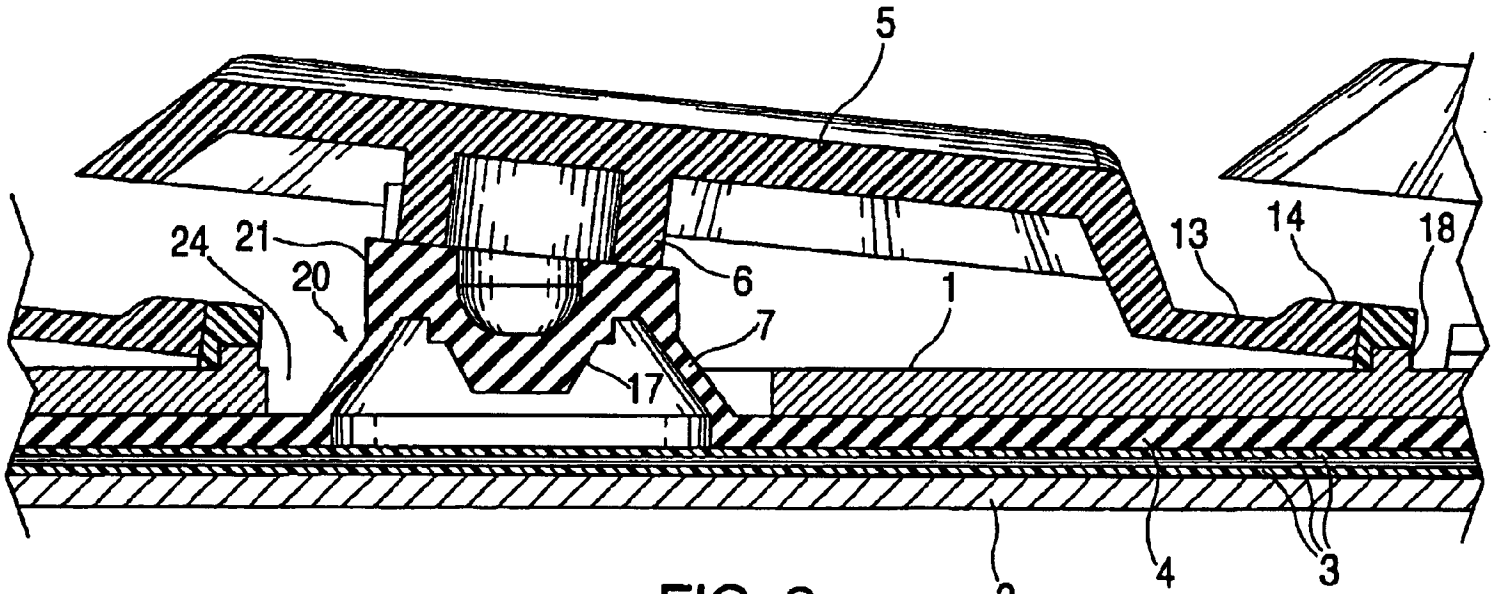
FIG. 2 is a half-section side view of a hinge key switch along axis "A" of FIG. 1, according to an embodiment of the present invention.
Figure 3:
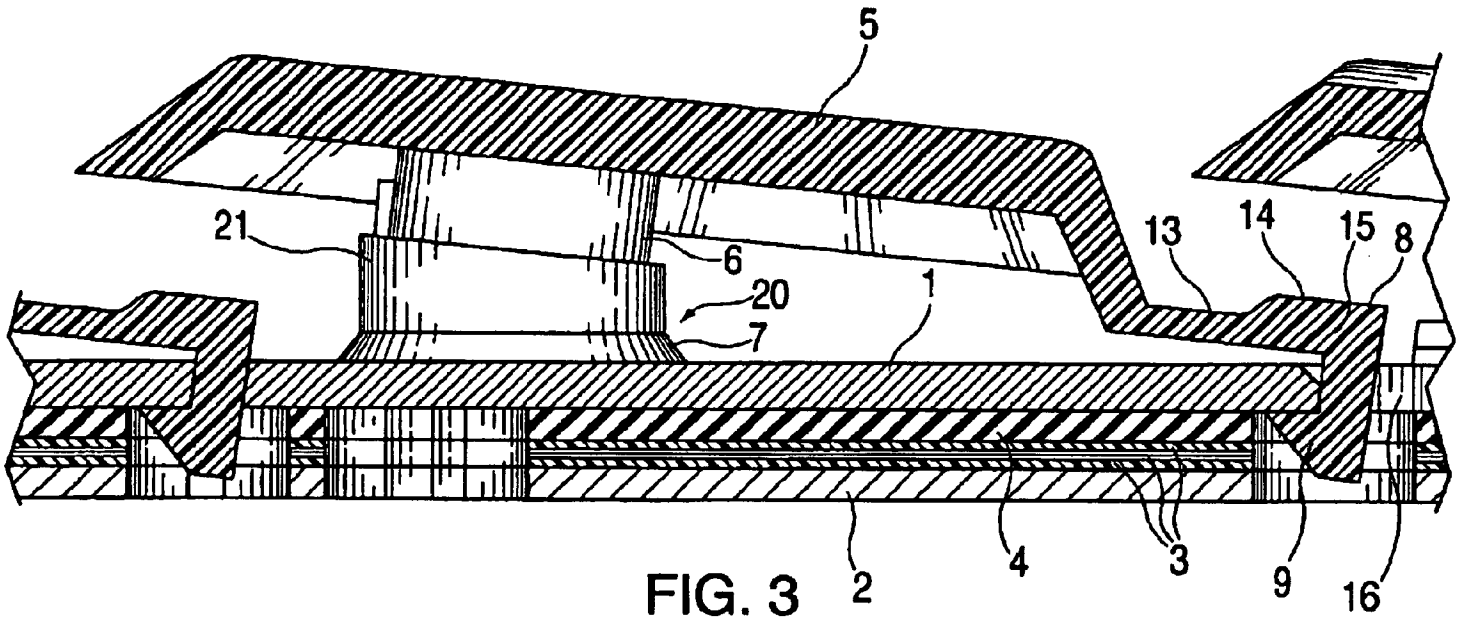
FIG. 3 is a half-section side view of a hinge key switch along axis "B" of FIG. 1, according to an embodiment of the present invention.

Referring now to FIGS. 2 and 3, a half section side view of one of the hinged key switches is shown. FIG. 2 is a half section side view of the hinged key switch along axis A of FIG. 1, while FIG. 3 is a half section side view of the hinged key switch along axis B of FIG. 1. Keyboard mounting plate 1 is affixed to back plate 2. Keyboard mounting plate 1 can be affixed to back plate 2 by a number of means. The preferred method is using screws drilled through the keyboard mounting plate 1 and back plate 2 at the four corner points, such that operation and movement of the keys are not interfered with.

Disposed between keyboard mounting plate 1 and back plate 2 is a signal membrane 3. Signal membrane 3 is well known in the art and usually consists of three individual sub-layers. The signal membrane acts to carry electrical signals from the keyboard to the electronic device. The three layers consist of a top and bottom layer of which one or both act as a circuit board having conductive pathways which carry the electrical signals, while the middle layer acts as a buffer between the top and bottom layer by means of its non-conductivity.

Also disposed between keyboard mounting plate 1 and back plate 2 is a rubber-sheet 4. Rubber sheet 4 resides on top of signal membrane 3 and is supported by both signal membrane 3 and the back plate 2.

Integrally formed on rubber sheet 4 is a resistance biasing mechanism 20 which extends upwards through slot 24 in keyboard mounting plate 1. In a preferred embodiment of the present invention, the resistance biasing mechanism 20 comprises a rubber spring 7. The rubber spring 7 is constructed of a flexible material and in the shape of a dome which has a hollow interior. The dome shape extends in an upward direction towards the key cap 5. The hollow interior of the dome allows the rubber spring 7 to be flexible, while the shape of the dome causes the rubber spring 7 to be biased towards the key cap 5. The construction of the rubber dome shape is well-known in the art, and accordingly is such that the dome is of such material and strength to create what is know as a "break-point". That is, when pressure is applied against the dome shape, the dome temporarily collapses under the pressure allowing the key to be depressed. When the pressure is removed, the dome of the rubber spring snaps back into its original form. This movement returns the key cap to its original position. At a top portion of the dome shape a circularly-shaped extension 21 extends vertically upwards (i.e., towards the key cap 5). This circularly-shaped extension 21 from the dome has a slight angle at the horizontal plane, as shown in the figures, such that the side away from pivot point 8 is higher and has a longer length than the opposite side which is closer to the pivot point 8.

Key cap 5 is formed so that a top surface of the key cap is easily manipulated by the fingers of a hand. At one end of key cap 5 an extension 13 is provided in a generally horizontal direction buttressed at its far end by a ledge 14. At both diagonal ends of this ledge 14, there is located a finger 15 which extends a little way as shown in the figures. A second part of the finger(s) 15 then extends in a vertically downward direction at approximately a 90 degree angle from the generally horizontal plain of the extension 14. The further extension of the finger 15 fits through a slot 16 in the keyboard mounting plate, and ends in a snap hook 9. Snap hook 9 cooperates with an underside of keyboard mounting plate 1 so as to prevent key cap 5 from disengaging from its position. It is to be understood, of course, that as many or as few finger extensions and snap hooks may be used to secure key cap 5 to keyboard mounting plate 1. Such construction allows for each key switch to have as few as one pivot point 8, and to place such towards a top of the keyboard. However, it is to be further understood that the construction of the key cap can be such that the pivot point can be placed towards the bottom of the key board or even towards either of the sides.

The key cap 5, extension 13, ledge 14 and finger 15 are generally rigid but permit enough give so that the key cap can move in the vertical direction. A circular extension 6 extends from an underside of key cap 5. Circular extension 6 cooperates with a top portion of the circular extension 7. As can be seen in the figure, circular extension 7 has a slight angle at the horizontal plane which helps enable it to securely maintain contact with circular extension 6. The horizontal angle also allows for equal pressure to be applied across the dome of the rubber spring so as to allow for an even feel when manually depressed and to avoid unnecessary wear on one portion of the dome thereof.

Figure 4:
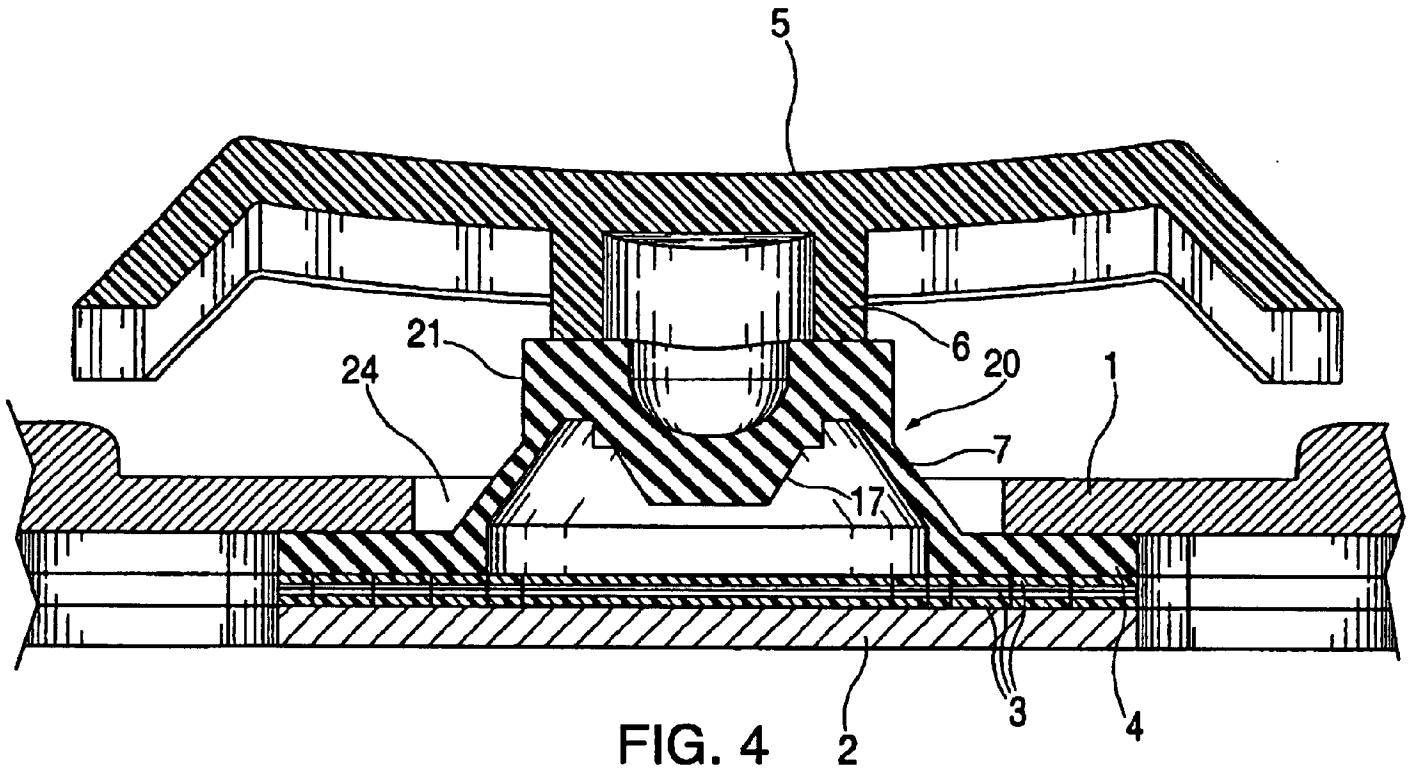
FIG. 4 is a half-section front view of a hinge key switch along axis "C" of FIG. 1, according to an embodiment of the present invention.

Referring now to FIG. 4, a half section drawing of the key switch along axis C of FIG. 1 is shown. When key cap 5 is manually depressed in a vertical direction downward, circular extension 6 pushes down on rubber spring 7. As rubber spring 7 is constructed having a hollow dome shape, the break-point of the dome is reached and it collapses slightly. The rubber spring 7 has from the circular vertical extension 21 on top of the dome shape a portion 17 thereof which recesses into the interior of the hollow dome shape. This recessed portion 17 of the vertical extension 21 of the dome shape acts as the electrical or mechanical initiator and also acts to stop the vertical downward movement of the circular extension 6 and key cap 5. Thus, collapse of the dome of the rubber spring 7 allows for the mechanical engagement of the electrical or mechanical initiator that contacts the signal membrane 3 and causes the appropriate electrical signal to be sent and/or received. Further in this manner, the vertical downward movement of the key cap 5 can be controlled and limited.

Figure 5:
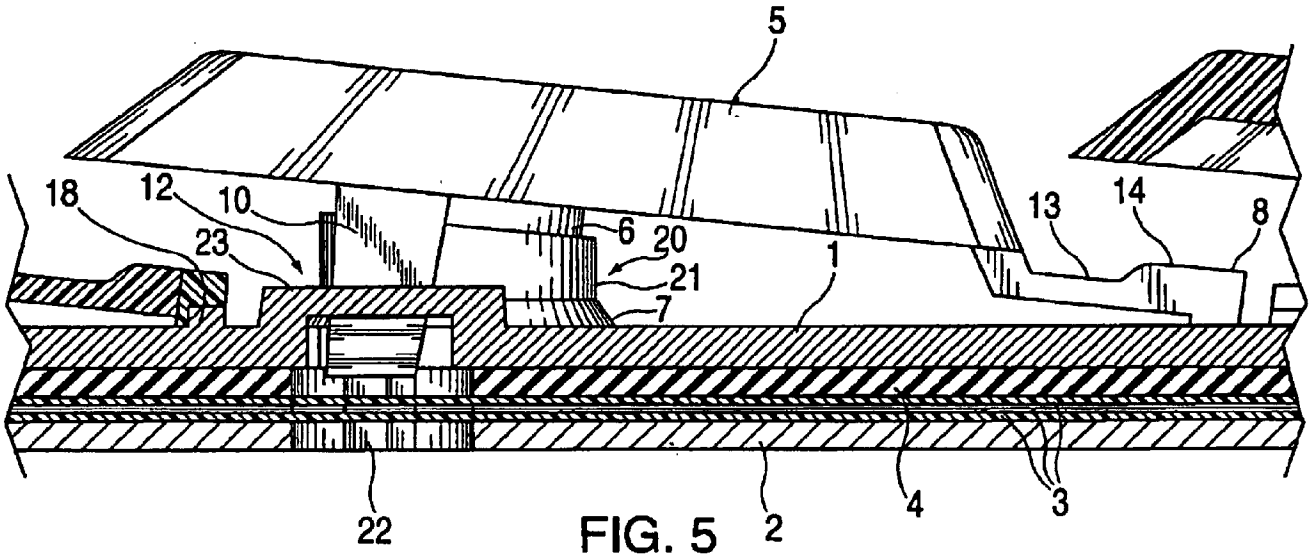
FIG. 5 is a half-section side view of a hinge key switch along axis "D" of FIG. 1, according to an embodiment of the present invention.
Figure 6:
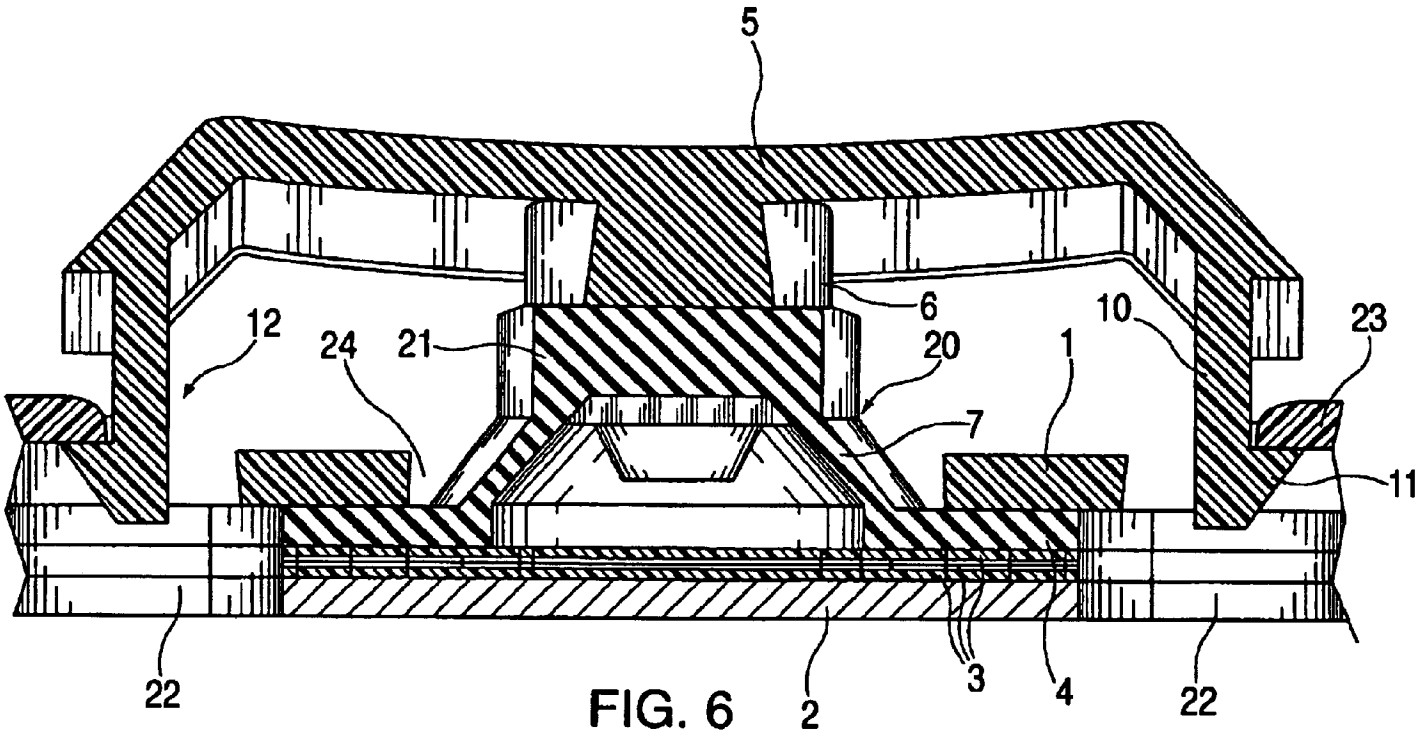
FIG. 6 is a half-section front view of a hinge key switch along axis "E" of FIG. 1, according to an embodiment of the present invention.
Figure 7:
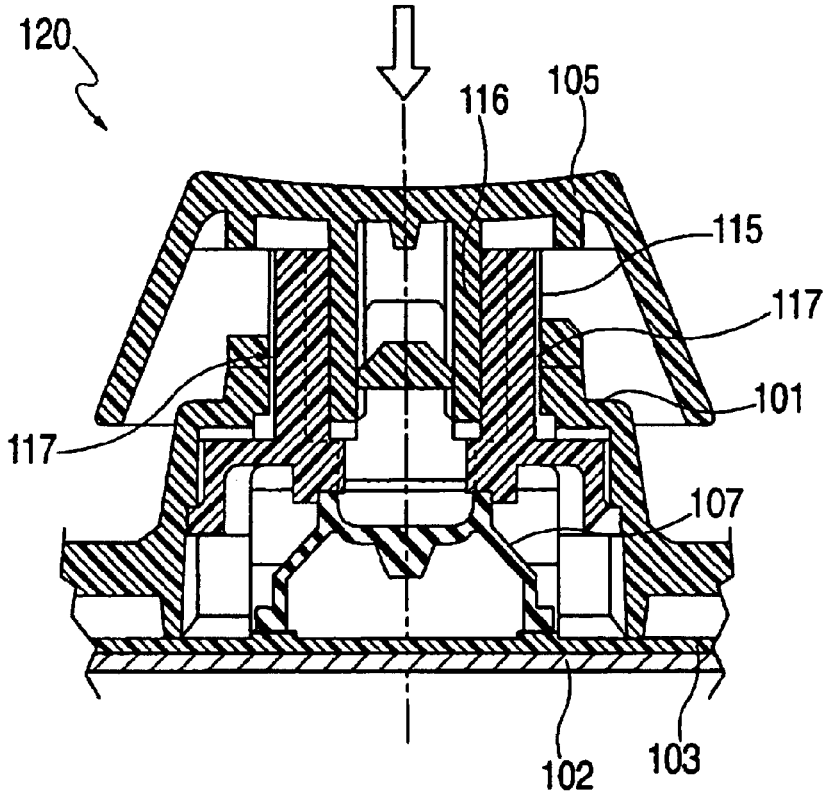
FIG. 7 (PRIOR ART)
FIG. 7 is a half-section side view of a plunger-type key switch, according to the prior art.
Figure 8:
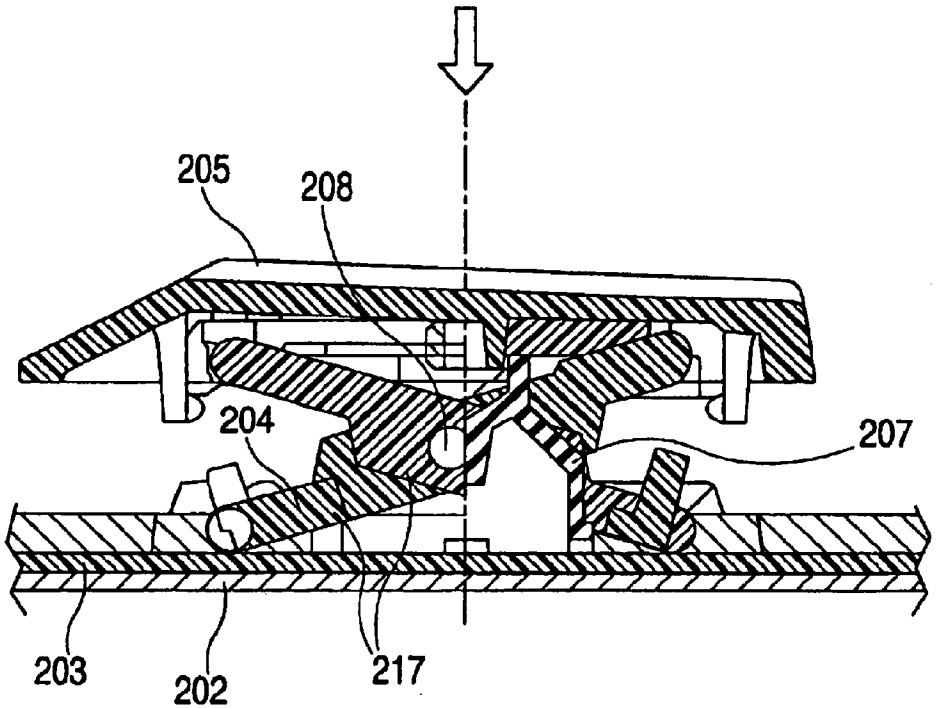
FIG. 8 (PRIOR ART)
FIG. 8 is a half-section side view of a scissors-type key switch, according to the prior art.

Referring now to FIGS. 5 and 6, a stopper mechanism 12 which prevents uncontrolled movement of key cap 5 in the vertical direction is shown. FIG. 5 is a half section side view of the hinged key switch along axis D of FIG. 1, while FIG. 6 is a half section front view of the hinged key switch along axis E of FIG. 1. On at least one side of key cap 5 is an arm 10 extending on an axis which is parallel to, but not necessarily on the same plain as, the axis of the rubber spring 7 and circular extension 6. Arm 10 extends into a slot 22 in keyboard mounting plate 1. Over the slot 22 in keyboard mounting plate 1 is a raised bridge 23 integrally formed thereto. On an end of arm 10 is a hook 11 extending therefrom in a horizontal direction which, when key cap 5 is in the upwards most position, comes into contact with an underside of raised bridge 23. In this manner then, when key cap 5 is being biased away from keyboard mounting plate 1, hook 11 and raised bridge 23 in combination prevent movement in a further upwards vertical direction. Arm 10 also stops movement in a vertically downward direction by coming into contact with the bottom of plate 2. Thus, arm 10, hook 11 and raised bridge 23 act in combination to limit the movement of the key switch and is thus referred to as stopper 12. It is to be understood, of course, that there may be more than one stopper mechanism for each key cap and that placement is not limited to one side or the other, but may be towards the top or bottom as well.

Accordingly, the construction of the key switch of the present invention allows for a unique design in which the key cap is a single unitary structure and in which there is only one moving part. Such construction allows for a less complex key switch which nevertheless retains a sleek low profile. Thus, the key switch of the present invention is easier and cheaper to manufacture, and has both simplicity and profile which are superior to any predecessors.

In the foregoing description, the apparatus and method of the present invention have been described with reference to specific examples. It is to be understood and expected that variations in the principles of the apparatus and method herein disclosed may be made by one skilled in the art and it is intended that such modifications, changes, and substitutions are to be included within the scope of the present invention as set forth in the appended claims. The specification and drawings are accordingly to be regarded in an illustrative rather than in a restrictive sense.

What is claimed:

1. Apparatus for a hinge key switch, comprising:

a keyboard mounting plate;

a key cap, comprising:

a top surface which is easily manipulated for manual depression;

a circular extension integrally connected to and extending from an underside of the key cap; and a finger integrally connected to and extending from a rear end of the key cap and ending in a snap hook, wherein the finger passes substantially vertically through a first slot in the keyboard mounting plate, and wherein the snap hook cooperates with an underside of the keyboard mounting plate, thus creating a hinge point around which the key cap can move;

a dome-shaped rubber spring, held in place by the keyboard mounting plate, biased towards the key cap and which contacts the circular extension; and a stopper mechanism which places limits on movement of the key cap around the hinge point, wherein when the key cap is manually depressed, the key cap rotates around the hinge point, and when the manual depression is removed, the rubber spring returns the key cap to its original position.

2. The apparatus according to claim 1, wherein the key cap further comprises:

a horizontal extension, extending from a lower portion of the key cap and from which the finger extends; and a ledge formed at an end of the horizontal extension away from the key cap and which buttresses the horizontal extension.

3. The apparatus according to claim 1, wherein the rubber spring further comprises:

a circular vertical extension at a top portion of the dome shape and with which contact of the circular extension is made.

4. The apparatus according to claim 3, wherein the rubber spring further comprises:

a portion of the circular vertical extension of the rubber spring which extends downward into the dome-shaped hollow and which allows for contact with a signal membrane when the key switch is manually depressed.

5. The apparatus according to claim 3, wherein the circular vertical extension at the top portion of the dome shape of the rubber spring is constructed at a slight angle to the horizontal plane.

6. The apparatus according to claim 1, wherein the stopper mechanism further comprises:

an arm, integrally connected to and extending from a side of the key cap through to a second slot in the keyboard mounting plate;

a raised bridge, integrally connected to the keyboard mounting plate and which partially covers the second slot; and a hook, integrally connected to the arm at an end away from the key cap, wherein when the key cap is manually depressed, the arm comes to abut a back plate thereby limiting movement of the key cap in a downwards direction, and when the key cap is released and the rubber spring biases the key cap back towards its original position, the hook abuts an underside of the raised bridge thereby limiting movement of the key cap in an upwards direction.

7. The apparatus according to claim 1, further comprising:

a back plate, to which the keyboard mounting plate is secured; and a signal membrane disposed between the keyboard mounting plate and back plate.

8. The apparatus according to claim 7, wherein the signal membrane further comprises:

a first layer having conductive pathways;

a second layer having conductive pathways; and a third layer, being non-conductive and disposed between the first and second layer, wherein the conductive pathways of the first and second layers conduct electric signals.

9. An apparatus for a binge key switch, comprising:

a keyboard mounting plate;

a key cap, wherein the key can further comprises:

a finger integrally connected to and extending from a rear end of the key cap and ending in a snap hook, wherein the finger passes substantially vertically through a first slot in the keyboard mounting plate, and wherein the snap hook cooperates with an underside of the keyboard mounting plate, thus creating a hinge point around which the key cap can move;

a resistance biasing mechanism for biasing the key cap in a vertically upwards direction; and a stopper mechanism, portions of which are integrally connected to a side of the key cap, for limiting movement of the key cap in the vertical direction, wherein when the key cap is manually depressed the resistance biasing mechanism and the stopper mechanism operate in conjunction to limit both the downward and upward movement of the key cap.

10. The apparatus according to claim 9, wherein the resistance biasing mechanism comprises:

a dome-shaped rubber spring, and wherein the key cap further comprises:

a circular extension, integrally connected to and extending from an underside of the key cap, which contacts the dome-shaped rubber spring.

11. The apparatus according to claim 10, wherein the dome-shaped rubber spring further comprises:

a circular vertical extension at a top portion of the dome shape and with which contact of the circular extension is made.

12. The apparatus according to claim 10, wherein the dome-shaped rubber spring further comprises:

a portion of the circular vertical extension of the rubber spring which extends downward into the dome-shaped hollow and which allows for contact with a signal membrane when the key switch is manually depressed.

13. The apparatus according to claim 12, wherein the circular vertical extension at the top portion of the dome shape of the rubber spring is constructed at a slight angle to the horizontal plane.

14. The apparatus according to claim 10, wherein the dome shape of the rubber spring allows for a break-point when manually depressed.

15. The apparatus according to claim 9, wherein the stopper mechanism comprises:

a raised bridge;

an arm, integrally connected to and extending from a side of the key cap; and a hook, integrally connected to the arm at an end away from the key cap, wherein when the key cap is manually depressed, the arm comes to abut a back plate thereby limiting movement of the key cap in a downwards direction, and when the key cap is released and the resistance biasing mechanism biases the key cap back towards its original position the hook abuts an underside of the raised bridge thereby limiting movement of the key cap in an upwards direction.

16. The apparatus according to claim 15, further comprising:

a keyboard mounting plate, secured to the back plate, and wherein the raised bridge, integrally connected to the keyboard mounting plate, partially covers a second slot in the keyboard mounting plate.

17. The apparatus according to claim 1, wherein the dome shape of the rubber spring allows for a break-point when manually depressed.

* * * * *